United States Patent [19]

Wells

[11] 4,149,835

[45] Apr. 17, 1979

[54] TEMPERATURE RESPONSIVE SEAL LUBRICATION FOR ROTARY MECHANISMS

[75] Inventor: Alan W. Wells, Edelstein, Ill.

[73] Assignee: Caterpillar Tractor Co., Peoria, Ill.

[21] Appl. No.: 824,600

[22] Filed: Aug. 15, 1977

[51] Int. Cl.[2] ..... G05D 23/02; F15D 1/00; F01C 19/00; F01C 21/04

[52] U.S. Cl. ..... 418/53; 418/76; 418/87; 418/97; 236/93 R; 138/45; 138/46; 277/26

[58] Field of Search ..... 418/53, 76, 83, 84, 418/87, 97–99; 236/93 R; 138/45, 46; 184/6.22, 7 R; 308/78, DIG. 14; 277/26

[56] References Cited

U.S. PATENT DOCUMENTS

| | | | |
|---|---|---|---|
| 1,768,558 | 7/1930 | Andrews | 138/46 |
| 1,871,287 | 8/1932 | Whittaker | 138/46 |
| 1,964,638 | 6/1934 | Kreidel | 236/93 |
| 2,418,671 | 4/1947 | Schweller | 236/93 |
| 2,604,077 | 7/1952 | Nast | 418/97 |
| 2,830,621 | 4/1958 | Prescott | 236/93 |
| 2,966,170 | 12/1960 | Raulins | 236/93 |
| 3,280,812 | 10/1966 | Peras | 418/97 |
| 3,340,893 | 9/1967 | Lockwood | 236/93 |
| 3,420,214 | 1/1969 | Bensinger et al. | 418/97 |
| 3,990,818 | 11/1976 | Loyd, Jr. | 418/97 |

*Primary Examiner*—John J. Vrablik

*Attorney, Agent, or Firm*—Wegner, Stellman, McCord, Wiles & Wood

[57] ABSTRACT

A rotary mechanism including a housing defining an operating chamber having a wall, a shaft journalled in the housing and having an eccentric within the chamber, a rotor within the chamber and journalled on the eccentric, and at least one seal carried by the rotor and slidably engaging the wall. A seal lubricating system is provided and includes an aperture in the wall along with a conduit for directing lubricant to the aperture. A plug partially closes the aperture and has a higher coefficient of thermal expansion than the housing, with the result that an oil-emitting gap is provided and its area changes proportional to temperature, and, thus, oil viscosity, to meter the proper amount of oil for seal lubrication irrespective of temperature.

8 Claims, 6 Drawing Figures

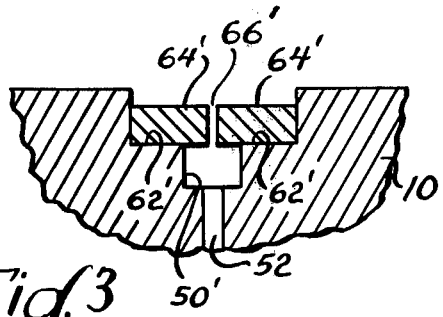
Fig. 3
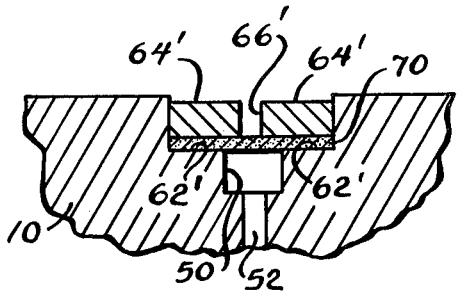
Fig. 4
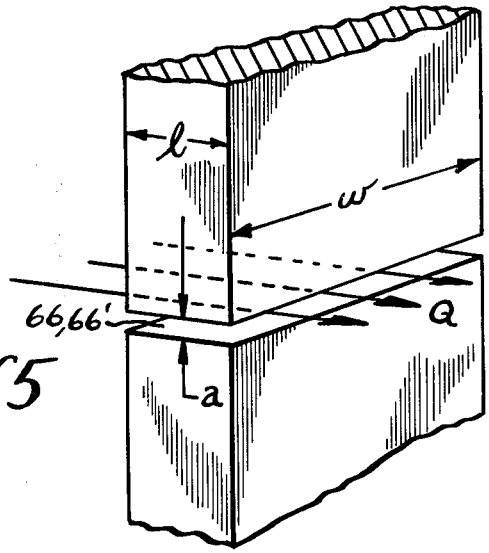
Fig. 5
Fig. 6
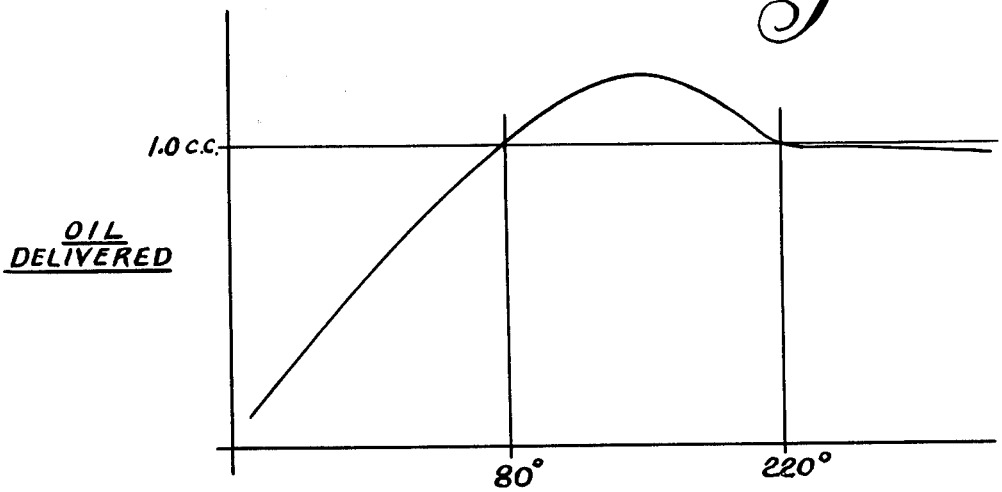

TEMPERATURE RESPONSIVE SEAL LUBRICATION FOR ROTARY MECHANISMS

BACKGROUND OF THE INVENTION

This invention relates to rotary mechanisms such as slant axis rotary mechanisms and trochoidal mechanisms which are frequently used as engines and, more specifically, to a seal lubricating means for use in such mechanisms.

As is well known, seals employed in rotary mechanisms require lubrication. In order to provide such lubrication, in some cases, the lubricant has been mixed with either air or the air-fuel mixture. Generally speaking, such a method is unsatisfactory because much of the lubricant does not participate in the combustion process and therefore contributes to emissions in the form of hydrocarbons.

More successful lubricating systems supply oil through apertures within housing walls and metering of the lubricant is accomplished externally at the lubricant pump or discharge valve associated with the pump as a function of engine speed or load.

Because the amount of lubricant required is relatively small, low delivery volume pumps have been used. Such pumps are difficult to make and, accordingly, expensive. Moreover, as wear occurs, the volume of oil delivered may vary appreciably.

SUMMARY OF THE INVENTION

The present invention is directed to overcoming one or more of the above problems.

According to the present invention, there is provided a rotary mechanism including a housing defining an operating chamber having a wall. A shaft is journalled in the housing and has an eccentric within the chamber. A rotor is disposed in the chamber and is journalled on the eccentric and at least one seal is carried by one of the wall and the rotor and slidably engages the other of the wall and rotor. Seal lubricating means are provided and comprise an aperture in the other of the wall and the rotor. Means are provided for directing lubricant to the aperture and a plug partially closes the aperture. The plug has a higher coefficient of thermal expansion than the other of the wall and the rotor. As a consequence, as temperature increases, thereby decreasing the viscosity of the lubricant, the plug expands at a more rapid rate than the aperture to fill an increasing percentage of the opening and decrease lubricant delivery area to compensate for the lesser viscosity of the lubricant at the elevated temperature.

Other objects and advantages will become apparent from the following specification taken in connection with the accompanying drawings.

DESCRIPTION OF THE DRAWINGS

FIGS. 3 and 4 are sectional view of modified embodiments of the seal lubricating means;

FIG. 5 is a view designed to illustrate certain dimensional relationships that may be employed in connection with use of the invention; and FIG. 6 is a graph illustrating oil flow versus temperature for one form of a seal lubricating means made according to the invention.

DESCRIPTION OF THE PREFERRED EMBODIMENT

Figure 1:
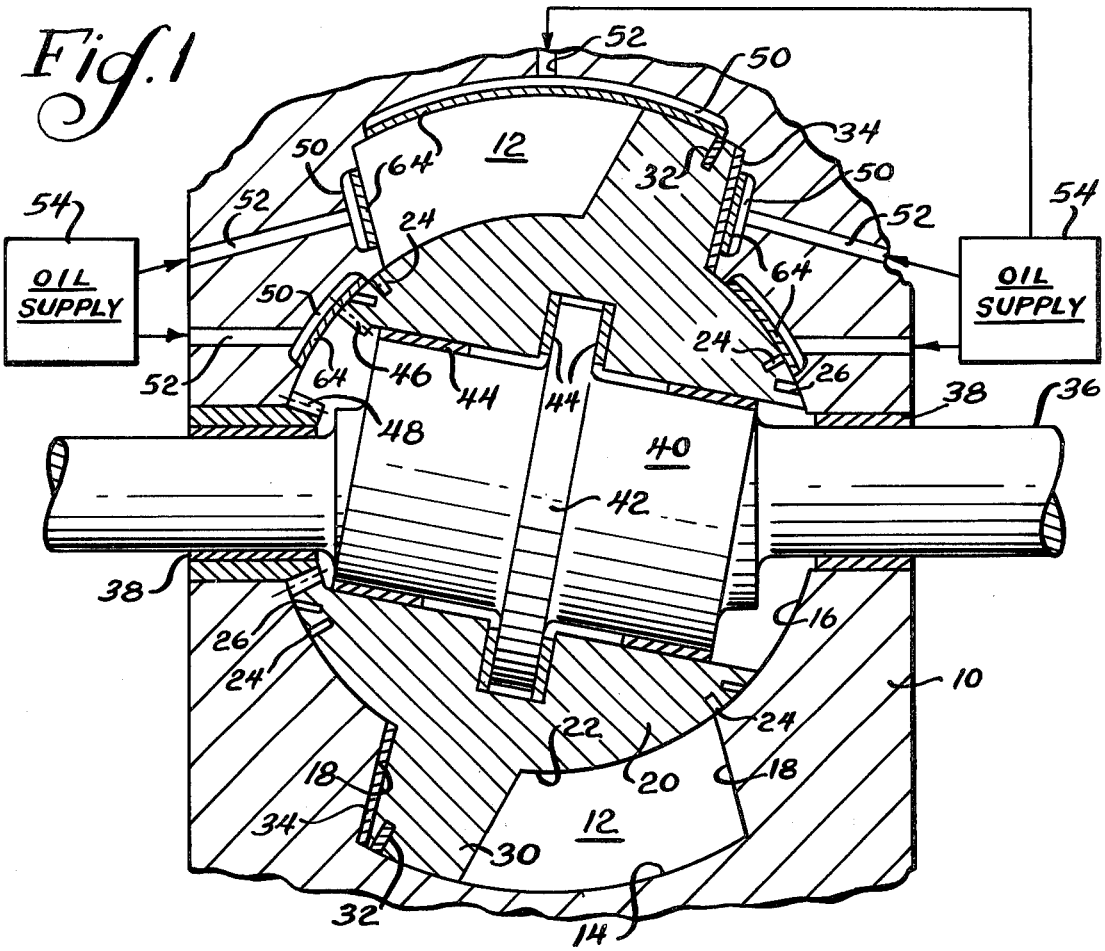
FIG. 1 is a sectional view of a rotary engine, specifically, a slant axis rotary engine, embodying seal lubricating means made according to the invention.

An exemplary embodiment of a rotary engine made according to the invention is illustrated in FIG. 1 in the form of a slant axis rotary mechanism employed as a four-cycle, slant axis rotary engine. However, it is to be understood that the invention is not limited to a four-cycle engine, but may be advantageously employed with mechanisms other than engines, such as compressors, pumps, expanders, or the like, and may be advantageously employed with mechanisms having a number of cycles other than four. It is also to be understood that the invention is applicable to other forms of rotary mechanisms, whether or not used as engines as, for example, trochoidal mechanisms.

The engine includes a housing 10 defining an operating chamber 12. The operating chamber 12 is bounded by an outer spherical wall 14, an inner spherical wall 16, and opposed generally radially extending side walls 18 which extend between the inner spherical wall 16 and the outer spherical wall 14. Those skilled in the art will recognize that the walls 18 are not truly radially extending but can assume a variety of configurations, depending upon the number of cycles of the mechanism. For example, for a four-cycle engine, the walls 18 will be an undulating frusto-cone.

Within the operating chamber 12, a rotor 20 is disposed. The same includes a spherical hub 22 carrying compression seals 24 and oil seals 26 in engagement with the inner spherical wall 16. The rotor 20 also includes an annular flange 30 carrying peripheral seals 32 in engagement with the outer spherical wall 14 and apex seals 34 engaging the radially extending walls 18. A shaft 36 is journalled, as by bearings 38, in the housing 10 and includes an eccentric 40 within the chamber 12 which, by means of a thrust collar 42, and a variety of bearings 44, journals the rotor 20 within the operating chamber 12.

One end of the rotor hub 22 includes an internal ring gear 46 which is in engagement with a stationary gear 48 carried by the housing 10 to establish a proper time relationship between the relative rates of rotation of the rotor 20, the shaft 36, and the housing 10. In a typical four-cycle mechanism, the shaft 36 will rotate through three revolutions for each single revolution of the rotor 20.

In the embodiment illustrated, each of the walls 14, 16 and 18 are provided with elongated slots 50 which are in fluid communication with conduits 52 which extend to a source of lubricating oil under pressure which may be the usual oil pump 54 associated with the engine for lubricating bearings, etc., or the like. Those skilled in the art will recognize that the various seals 24, 32 and 34 are elongated and the slots 50 in the walls against which such seals respectively slidably bear are elongated in a direction at an acute angle (including 90° but not including 0° ) to the mean direction of seal travel on such wall.

In FIG. 1, the slots 50 in the spherical walls 14 and 16 are shown in approximately the correct orientation. Conversely, while the slots 50 and the walls 18 are shown as generally radially extending from the axis of the shaft 36, because of the desired that an acute angle exist, and the fact that the seals 34 are elongated in a direction extending through the axis of rotation of the shaft 36, it is preferred that the slots 50 have their axis of elongation extending to one or the other of the sides of the shaft 36.

Figure 2:
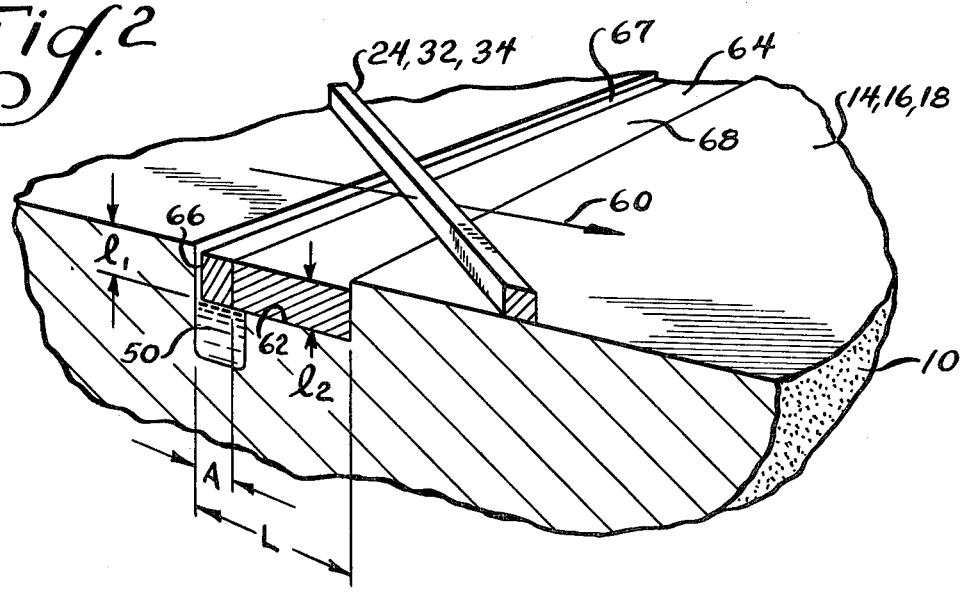
FIG. 2 is a somewhat schematic, enlarged, perspective view of the seal lubricating means.

Turning now to FIG. 2, the nature of the lubricating means will be described in greater detail. FIG. 2 illustrates the housing 10 and a wall for the chamber 14 therein which may be any of the walls 14, 16 and 18. A seal, which may be either of the seals 24, 32 and 34 is illustrated as moving across the slot 50 in the direction of an arrow 60 with the direction of elongation of the slot 50 being at an acute angle with respect to the mean path of seal travel. The slot 50 includes a step 62 and a strip 64 is bonded to the step 62 by any suitable means to partially close the slot 50 leaving only a small gap 66. The strip 64 has a higher coefficient of thermal expansion than the housing 10 (or if the walls 14, 16 or 18 are defined by a liner separate from the housing 10, a higher coefficient of thermal expansion than that of the liners). Because of the higher thermal coefficient of expansion of the strip 64, it is desirable that the depth of the step 62, $l_1$, be sufficiently greater than the width, $l_2$, of the strip 64 such that at the hottest temperature to which the strip 64 is exposed, the same will not expand inwardly of the wall 14, 16 or 18 into the area of the chamber 12 occupied by the rotor or the seals 24, 32 and 34.

The strip 64 essentially serves as a plug for the slot 50 and is made to be essentially side to side across the width of the slot 50 when it is at the maximum temperature to which it will be exposed in use. Of course, at lesser temperatures, the width of the gap 66 will progressively increase. The gap 66 serves as a metering gap whose size increases inversely with respect to temperature. Due to viscosity changes in the lubricant with changes in temperature, flow rates thereof at given pressures will vary proportionally to temperature. According to the present invention, the changing size of the gap 66 due to differential thermal expansion between the strip 64 and the housing 10, compensates for changes in flow characteristics of the lubricant due to temperature so that a by-and-large constant flow of lubricant is provided regardless of temperature.

Even when the strip 64 is at its maximum temperature, and therefore substantially closes the slot 50, due to surface roughness at the interface between the side of the slot 50 and the strip 64, lubricant will nonetheless ooze out of the slot 50 at the desired rate.

As seen in FIG. 2, the strip 64 is a composite formed of first and second elements 67 and 68. Many materials having a higher coefficient of expansion than that of which the housing 10 of which the strip 64 may be formed are relatively weak and/or soft. For example, when the housing 10 is formed of cast iron or steel, aluminum would be useful for the plug material and may therefore be employed in forming the element 67. However, due to its softness, the invention contemplates that it be rigidified by the second element 68 to which it may be bonded. The second element will be a relatively strong or hard material and can be a material, such as iron, which has the same coefficient of expansion as the housing material. The second element 68 may even have a lesser coefficient of thermal expansion than the material of which the housing 10 is formed, but it is required that the coefficient of thermal expansion of the composite strip in the direction extending across the slot 50 be greater than the coefficient of thermal expansion of the material of which the housing 10 (or the liner, if any) is made.

FIGS. 3 and 4 illustrate modified embodiments. In FIG. 3, there is provided a slot 50' having two steps 62' on opposite edges of the main body of the slot 50'. Two strips 64' define a metering gap 66' between the two. The strips 64' are sized to substantially close the gap 66' when at the hottest contemplated operating temperature.

In some instances, it may be desirable to use a wicking material to promote even distribution of oil flow along the length of the gap 66'. FIG. 4 shows such an embodiment wherein the strips 64' are bonded to a sheet of wicking material 70 which, in turn, is supported on the steps 62'. The sheet 70 may be a so-called "foamed metal" such as that sold under the trademarks "RETIMET" or "FELTMETAL".

In a slant axis rotary engine rated at approximately 150 hp, it is desirable to provide about one cc. per minute of lubricant in total to all seals requiring such lubrication. In such a case, the gap 66 or 66' approximately 80° F. would be on the order of about 40 microinches. The dimension A illustrated in FIG. 2 would be on the order of about 0.050 inches.

In some cases, it may be desirable to increase the amount of lubricant with increasing engine load or engine speed. This can be accomplished by readjusting the pressure of the oil supplied to the slot 50 and 50' in a known manner. The changes in pressure necessary to provide a given flow rate can be ascertained from the following equation:

$$Q = a^3 \times (p/12\ \mu l)$$

where:

Q—is the flow rate in cubic feet per second, a—is the width of the gap 66 or 66' in feet, p—is the pressure drop across the gap 66 or 66' in pounds per square foot, $\mu$—is the viscosity of the lubricant in pounds-seconds per foot squared, and L—is the depth of the gap 66 or 66' in the direction of flow in feet.

The foregoing dimensions are applied to structure as illustrated in FIG. 5.

In the usual case, the slots 50 will be located closely adjacent the intake port of the engine with the consequence that there will be little or no backpressure within the operating chamber 12 resisting the flow of oil through the gap 66 and 66' so that p will be equal to the pressure of the lubricant within the slot 50 or 50'.

FIG. 6 illustrates how substantially constant flow of a lubricant is attained in a seal lubricating means made according to the invention wherein no effort is made to adjust flow proportional to engine speed or load using SAE 10W oil and an effective dimension of an aluminum strip 64 of about 0.049 inches (that dimension whose expansion or contraction due to thermal response widens or narrows the gap 66 or 66'). In general, it is preferred that at temperatures about 220°, flow through the gap 66', which will be essentially closed at this point, be controlled by preformed surface irregularities therein.

From the foregoing, it will be appreciated that a seal lubricating means made according to the invention eliminates the need for expensive low volume delivery pumps and yet provides for effective metering of lubricating oil to seals requiring the same.

The embodiments of the invention in which an exclusive property or privilege is claimed are defined as follows:

1. A mechanism comprising:

first and second relatively movable parts, a seal carried by one of said parts and sealingly and slidably engaging the other of said parts, and seal lubricating means comprising an aperture in said other part, means for supplying a lubricant to said aperture, a thermally responsive, lubricant metering plug partially defining said aperture and having a coefficient of thermal expansion greater than that of said other part.

2. In a rotary mechanism, the combination of:

a housing defining an operating chamber having a wall;

a shaft journalled in said housing and having an eccentric within said chamber;

a rotor within said chamber and journalled on said eccentric;

at least one seal carried by said rotor and slidably engaging said wall; and seal lubricating means comprising an aperture in said wall, means for directing lubricant to said aperture, and a thermally responsive, lubricant metering plug partially defining said aperture and having a higher coefficient of thermal expansion than said housing.

3. The rotary mechanism of claim 2 wherein there are two said plugs with a gap therebetween.

4. In a rotary mechanism, the combination of:

a housing defining an operating chamber having a wall;

a shaft journalled in said housing and having an eccentric within said chamber;

a rotor within said chamber and journalled on said eccentric;

at least one seal carried by one of the wall and the rotor and slidably engaging the other of the wall and the rotor; and seal lubricant means comprising an aperture in said other of the wall and the rotor, means for directing lubricant to said aperture, and a thermally responsive, lubricant metering plug partially defining said aperture and having a higher coefficient of thermal expansion than said other of the wall and the rotor.

5. In a rotary mechanism, the combination of:

a housing defining an operating chamber having a wall;

a shaft journalled in said housing and having an eccentric within said chamber;

a rotor within said chamber and journalled on said eccentric;

at least one seal carried by said rotor and slidably engaging said wall; and seal lubricant means comprising an elongated slot in said wall, means for directing lubricant to said slot, and a thermally responsive, lubricant metering elongated strip partially defining said slot and having a higher coefficient of thermal expansion than said housing.

6. The rotary mechanism of claim 5 wherein said seal is elongated and said slot is at an acute angle to the direction of mean seal travel.

7. The rotary mechanism of claim 5 wherein said slot includes a step and said strip is mounted within said step.

8. The rotary mechanism of claim 7 wherein said strip is a composite structure formed from two side by side elements, one having said higher coefficient of thermal expansion and the other being formed to support said one element.

* * * * *